US005911418A

United States Patent [19]

Adams

[11] Patent Number: 5,911,418

[45] Date of Patent: Jun. 15, 1999

[54] METHODS OF PLAYING CARD GAMES WITH AN ADDITIONAL PAYOUT INDICATOR

[75] Inventor: William R. Adams, Las Vegas, Nev.

[73] Assignee: Anchor Gaming, Las Vegas, Nev.

[21] Appl. No.: 08/948,993

[22] Filed: Oct. 10, 1997

[51] Int. Cl.[6] ..... A63F 1/00; A63F 5/04

[52] U.S. Cl. ..... 273/274; 273/292; 273/142 R; 273/309

[58] Field of Search ..... 273/292, 274, 273/309, 142 R; 463/13

[56] References Cited

U.S. PATENT DOCUMENTS 4,906,005 3/1990 Manabe ..... 273/142 R
5,167,413 12/1992 Fulton ..... 273/274
5,486,005 1/1996 Neal ..... 273/292
5,707,285 1/1998 Place et al. ..... 463/12

*Primary Examiner*—Benjamin H. Layno
*Attorney, Agent, or Firm*—Galgano & Burke

[57] ABSTRACT

A card game particularly suited for gaming wherein, in addition to payouts determined by the rank of a player's hand against a predetermined payout schedule or against the hands of a dealer or other players, a player may qualify for a payout determined by a movable payout indicator, preferably in the form of a rotatable wheel. A player can qualify for a spin of the wheel which indicates a prize by attaining a predetermined hand or one of a plurality of a predetermined hands. As an additional condition, the player may be required to place more than a minimum wager in order to qualify for a payout determined by the movable payout indicator. A player who has won a prize from a spin of the wheel may also be provided with an opportunity to double his winnings with an additional actuation of the movable payout indicator or in some other fashion.

59 Claims, 2 Drawing Sheets

METHODS OF PLAYING CARD GAMES WITH AN ADDITIONAL PAYOUT INDICATOR

The present invention is directed to novel methods of playing card games of chance.

BACKGROUND OF THE INVENTION

Card games have been enjoyed by people for years and have enjoyed widespread popularity in recent times. Many people enjoy playing a wide variety of card games that they have not played before. Playing new card games adds to the excitement of this recreational activity particularly when some form of "gaming" is involved. As used herein, the term "gaming" is used to indicate that some form of wagering is involved, and that players must make wagers of value, whether actual currency or some equivalent of value, e.g., token or credit.

Since it is desirable to offer players card games which they have not played before, it would be desirable to provide players with new card games and additional opportunities to receive winning payouts.

Those familiar with games involving winning payouts, such as the popular television game show entitled "WHEEL OF FORTUNE" will realize that as players and observers watch a wheel spin and gradually come to rest, the players experience a heightened feeling of anticipation and excitement as the wheel is slowing down to indicate a possible prize. It is believed that it would also be desirable to provide a card game with a payout indicator which is discernible by a player and/or other observers.

SUMMARY OF THE INVENTION

Various embodiments of the present invention comprise methods of playing card games and table games utilizing a card game and at least one discernible indicia of a payout indicator, preferably in the form of a rotatable wheel.

According to the most preferred embodiments, a payout indicator is clearly visible to a player and is operable when a player attains a predetermined hand or one of several predetermined hands, and has placed the required wager(s).

According to one preferred embodiment of the present invention, a secondary payout indicator is in the form of a rotatable payout indicator wheel which can be caused to spin by a dealer who initiates rotation of the wheel manually or electronically by depressing a SPIN THE WHEEL BUTTON, or in response to some action by a player, e.g., the player pushing a button, when the wheel is actuatable. The wheel is preferably caused to gradually reduce speed and when the wheel stops, a pointer indicates the payout or prize to be awarded to the player. According to another preferred embodiment of the present invention, the payout indicator is connected to a drive mechanism which gradually reduces the rate of spin of the wheel before the wheel stops.

Another preferred embodiment of the present invention further comprises a double or nothing feature to a player who has spun the wheel or utilized some other movable payout indicator.

According to one preferred embodiment of the present invention, the movable payout indicator is electronically operated and is linked to a random number generator which determines where the payout indicator actually stops.

According to another embodiment of the present invention, a payout indicator actuator requires dealer intervention to activate the payout indicator.

The present invention also comprises methods for playing a game of chance. One preferred method comprises the steps of A method of playing a card game comprising the steps of providing a display surface; providing at least one player with the option of placing an initial wager; displaying indicia of at least one playing card to at least one player; providing at least one player with an opportunity to change said player's initial wager to a resulting wager which is different from said initial wager; displaying at least one additional card; and displaying indicia of a movable, payout indicator.

Further embodiments of the present invention comprises a method of playing a card game comprising the steps of providing a display surface; displaying a winning payout schedule comprising a preselected plurality of winning card combinations; providing at least one player with the option of placing a wager; displaying a plurality of indicia of cards to at least one player; providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome; displaying at least one additional card; comparing a plurality of said displayed indicia of cards with said payout schedule; and if a plurality of said displayed cards matches at least one of said preselected winning card combinations, rendering a movable payout indicator actuatable.

DETAILED DESCRIPTION

Figure 1:
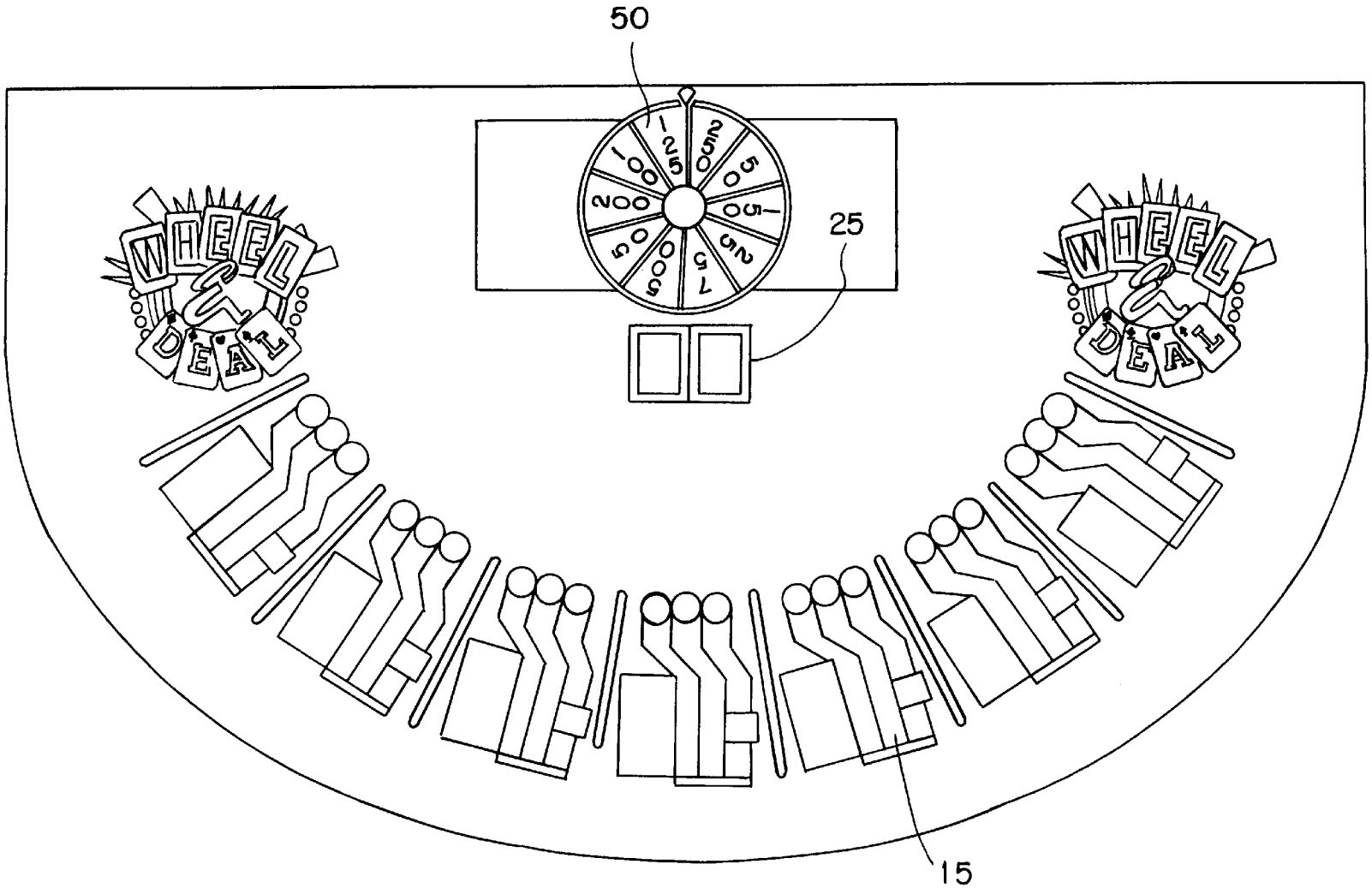
FIG. 1 is a top view of one table game embodiment of the present invention.

The various embodiments of the present invention are designed to provide added excitement to a board/table card game in order to increase the enjoyment to players and to serve as an added attraction to potential players. One preferred embodiment of the present invention, illustrated in FIGS. 1 and 2, comprises a table game with a display surface having seven player wagering stations. According to this preferred embodiment, each player station comprises three wagering areas 15 which indicate the amount to be wagered by the players, a common card area 25 and a rotatable payout indicator wheel 50.

According to this illustrated embodiment, a player desiring to play places a first wager in first wager area 15*a* and receives three cards from the dealer. The dealer also places two cards face down in the common card area 25. The two common cards are used to complete the partial hands of all players. If the player does not make any additional wagers after placing his first wager, then his hand will be resolved according to the payout schedule 20*a* indicated for the first bet. If the player so desires, he has an opportunity to place a second wager before the first common card 25*a* is revealed. If the player makes a second wager in wager area 15*b* and does not proceed with a third wager, and receives a winning hand he will be paid out according to the second payout schedule 20*b*. Similarly, a player may also make a third wager in wager area 15*c* prior to the display of the second common card in common card area 25*b*. If a player makes a third wager, any winning payout will be paid according to a third payout schedule 20*c*. Therefore, according to this preferred embodiment of the present invention, a player is provided with an opportunity to increase his wager even after he may have received a definite indication of the ultimate success of his hand. It is not necessary, however, in order to enjoy some of the benefits of the present invention, for a player to be provided with an opportunity to change his wager or the effective payout schedule. Therefore, a player can play another table/board card game and upon receiving a predetermined hand or one of a predetermined plurality of qualifying hands, he can be provided with an opportunity to SPIN THE WHEEL in the manner discussed below.

Furthermore, if a player has made all three wagers and if he attains one preselected hand or one of a plurality of preselected hands, the player will qualify to SPIN THE WHEEL for his payout. According to the illustrated embodiment of the present invention a player only qualifies to spin the wheel if he has made a third bet and his hand forms a straight, flush or full house. Therefore, higher hands including a royal flush, straight flush, or four of a kind will not qualify the player for a spin of the wheel nor will lower hands such as a pair, two pair, or three of a kind. While the illustrated embodiment requires a player to place all three bets in order to qualify for a spin of the wheel, it is also within the scope of the present invention to permit a spin of the wheel upon attaining a preselected hand, or one of a plurality of a preselected hands, even if the player has only made one or two wagers.

The second and third bets of the preferred illustrated embodiment of the present invention can be required if a player is to remain within a hand and have any opportunity of winning, but are most preferably optional wherein a player could remain in the hand to see the common cards even if he has only placed a single wager.

Figure 2:
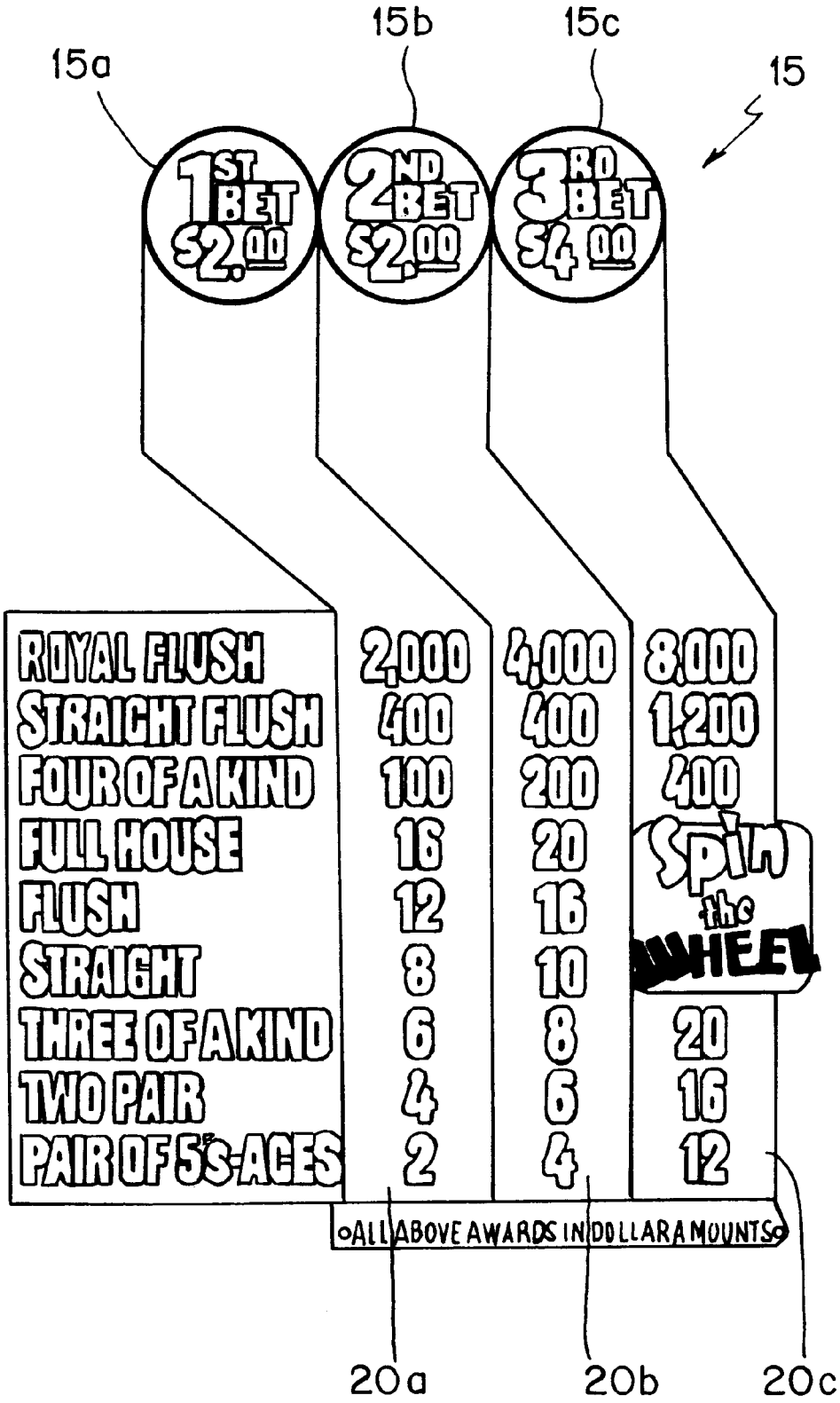
FIG. 2 illustrates payout schedules useful with the table game shown in FIG. 1.

As illustrated in FIG. 2, the payout schedules 20*a*, 20*b*, 20*c* of this preferred illustrated embodiment change with each bet placed by the player and are not in the same proportion to the amount wagered. The payout schedules shown in FIG. 2 are merely for illustration purposes and, as will be appreciated by those skilled in the art, can be changed without departing from the scope of the present invention.

When a player receives a card hand which qualifies him to SPIN THE WHEEL, a dealer will preferably place a puck or other indicator close to the player's wagering area before resolving other player's wagers. The wheel 50 is then actuatable in a predetermined manner. For example, a dealer may need to depress a button in order to unlock the wheel and render it rotatable. This feature is not necessary to the practice of the present invention but may be desirable. The dealer can then initiate rotation of the wheel either manually or electronically. For example, the dealer can either give the wheel a spin with his hand or simply depress a button which will initiate rotation of the wheel. Most preferably, while the wheel is spinning, the continued and final movement of the wheel will be controlled by some electronic device for example, a stepper motor which is most preferably linked to a random numbered generator. In this manner, the actual outcome of the wheel can be actually established electronically while the wheel gives observers a sense of a purely mechanical outcome. Prior to stopping, the rate of rotation of the wheel is most preferably reduced somewhat gradually in order to increase the excitement to the players. While the illustrated wheel indicates dollar amounts of attainable prizes, other items of value may also be utilized such as a car, a cruise, or a payout from a progressive jackpot. Furthermore, according to another embodiment of the present invention, the wheel may comprise spaces which do not result in a prize to a player.

After a player has received an indication of an award on the wheel, players are most preferably given a DOUBLE OR NOTHING option by the dealer. If a player elects to go for DOUBLE OR NOTHING, the dealer preferably spins the wheel again. The wheel is most preferably marked with alternating colors and, if the second spin of the wheel results in the indication of the same color as had the first spin of the wheel, then the player's prize gets doubled. In this fashion, the player can be given opportunities to redouble his already doubled winnings. Those skilled in the art will appreciate that some limit may be placed on this doubling feature by the gaming establishment.

It is also within the scope of the present invention to allow a player to initiate the spin of the wheel either manually or electronically.

I claim:

1. A method of playing a card game comprising the steps of:

providing a display surface;

providing at least one player with the option of placing a wager;

displaying a payout schedule comprising a preselected plurality of winning card combinations;

displaying indicia of at least one playing card to at least one player;

providing said player with an opportunity to change the amount of said player's wager;

displaying at least one additional card; and displaying indicia of a movable, payout indicator wherein said indicia of a movable payout indicator is actuatable only if a player has changed the amount wagered.

2. A method of playing a card game according to claim 1 wherein said display surface comprises a portion of a game board.

3. A method of playing a card game according to claim 2 wherein said display surface comprises wagering areas for a plurality of players.

4. A method of playing a card game according to claim 1 wherein said indicia of a movable payout indicator comprises a wheel.

5. A method of playing a card game according to claim 4 further comprising the steps of rotating said wheel.

6. A method of playing a card game according to claim 5 wherein rotation of said wheel is initiated manually.

7. A method of playing a card game according to claim 6 wherein rotation of said wheel is controlled, at least in part, with means for randomly selecting the ultimate position of said wheel.

8. A method of playing a card game according to claim 7 wherein said selecting means comprises a motor.

9. A method of playing a card game according to claim 5 wherein rotation of said wheel is initiated electronically.

10. A method of playing a card game according to claim 9 wherein rotation of said wheel is controlled, at least in part, with means for randomly selecting the ultimate position said wheel.

11. A method of playing a card game according to claim 10 wherein said selecting means comprises a motor.

12. A method of playing a card game according to claim 1 further comprising the steps of:

providing at least one player with an opportunity to change the amount of said player's wager;

providing said player with an opportunity to maximize said player's winnings even after receiving an indication of the hands ultimate outcome; and providing a winning payout based on said resulting wager if a plurality of said displayed cards matches at least one preselected winning card combination.

13. A method of playing a card game according to claim 12 wherein winning payouts are provided according to a schedule which provides different payout schedules for different amounts wagered, for at least one winning hand.

14. A method of playing a card game according to claim 12 wherein said movable payout indicator is actuatable only if a player received a preselected qualifying card combination.

15. A method of playing a card game according to claim 12 further comprising the step of providing a winning player with an opportunity to double his winning payout.

16. A method of playing a card game according to claim 15 further comprising the step of providing a winning player with a plurality of opportunities to double said player's winning payout.

17. A method of playing a card game according to claim 1 wherein said movable payout indicator is actuatable only if a player received a preselected qualifying card combination.

18. A method of playing a card game according to claim 1 further comprising the step of displaying a payout schedule to each player.

19. A method of playing a card game according to claim 1 wherein said display surface comprises a video screen.

20. A method of playing a card game according to claim 1 wherein said step of displaying a payout schedule comprises displaying a payout schedule comprising hands wherein the number of cards necessary to attain at least one of said winning hands is less than the number of cards needed to attain at least one other of said winning hands.

21. A method of playing a card game according to claim 1 comprising the step of providing means for receiving a plurality of wagers.

22. A method of playing a card game according to claim 21 wherein said step of providing means for receiving a plurality of wagers comprises providing at least one designated wager area on a game board.

23. A method of playing a card game according to claim 21 wherein said display surface and said receiving means are provided on a single gaming table.

24. A method of playing a card game according to claim 1 wherein said player may change the amount wagered and wherein said winning payout is based on the final amount wagered.

25. A method of playing a card game according to claim 1 wherein the total number of cards displayed for each hand is five.

26. A method of playing a card game according to claim 1 wherein the total number of cards displayed for each hand is seven.

27. A method of playing a card game comprising the steps of:

providing a display surface;

providing at least one player with the option of placing a wager;

displaying indicia of at least one playing card to at least one player;

providing said player with an opportunity to place a second wager;

displaying at least one additional card;

displaying indicia of a movable, payout indicator;

wherein said movable payout indicator is actuatable only if a player has placed at least two wagers.

28. A method of playing a card game according to claim 27 wherein said movable payout indicator is actuatable only if a player has placed at least three wagers.

29. A method of playing a card game comprising the steps of:

providing a display surface;

providing a peselected plurality of winning card combinations, said plurality of winning card combinations comprising a lowest value card combination and a higher value card combination;

providing at least one player with the option of placing a wager;

displaying indicia of at least one playing card to at least one player;

displaying at least one additional card;

displaying indicia of a movable, payout indicator;

wherein said movable payout indicator is actuatable only if a player received a preselected qualifying card combination; and wherein said qualifying card combination has a higher value than the lowest card combination which provides a winning payout.

30. A method of playing a card game comprising the steps of:

providing a display surface;

providing a preselected plurality of winning card combinations, said plurality of winning card combinations comprising a highest value card combination and a lower value card combination;

providing at least one player with the option of placing a wager;

displaying indicia of at least one playing card to at least one player;

displaying at least one additional card;

displaying indicia of a movable, payout indicator;

wherein said movable payout indicator is actuatable only if a player received a preselected qualifying card combination; and wherein said qualifying card combination has a lower value than the highest card combination which provides a winning payout.

31. A method of playing a card game according to claim 1 further comprising the step of providing a winning player with an opportunity to double his winning payout.

32. A method of playing a card game comprising the steps of:

providing a display surface;

providing at least one player with the option of placing a wager;

displaying indicia of at least one playing card to at least one player;

displaying at least one additional card;

displaying indicia of a movable, payout indicator;

providing a winning player with an opportunity to double his winning payout;

wherein a player's success in doubling a winning payout is displayed with said movable payout indicator.

33. A method of playing a card game according to claim 31 further comprising the step of providing a winning player with a plurality of opportunities to double said player's winning payout.

34. A method of playing a card game comprising the steps of:

providing a display surface;

providing a preselected plurality of winning combinations;

providing at least one player with the option of placing a wager;

displaying indicia of at least one playing card to at least one player;

displaying at least one additional card;

displaying indicia of a movable, payout indicator;

providing at least one player with an opportunity to change the amount of said player's wager;

providing said player with an opportunity to maximize winnings of said player even after the player received an indication of the hands ultimate outcome; and providing a winning payout based on said resulting wager if a plurality of said displayed cards matches at least one preselected winning card combination;

wherein said indicia of a movable payout indicator comprises a wheel.

35. A method of playing a card game according to claim 34 wherein said movable payout indicator is actuatable only if a player has changed the amount wagered.

36. A method of playing a card game comprising the steps of:

providing a display surface;

providing a preselected plurality of winning combinations;

providing at least one player with the option of placing a wager;

displaying indicia of at least one playing card to at least one player;

displaying at least one additional card;

displaying indicia of a movable, payout indicator;

providing at least one player with an opportunity to change the amount of said player's wager;

providing said player with an opportunity to maximize said player's winnings even after receiving an indication of the hands ultimate outcome;

providing a winning payout based on said resulting wager if a plurality of said displayed cards matches at least one preselected winning card combination; and wherein said movable payout indicator is actuatable only if a player has placed at least two wagers.

37. A method of playing a card game according to claim 36 wherein said movable payout indicator is actuatable only if a player has placed at least three wagers.

38. A method of playing a card game comprising the steps of:

providing a display surface;

providing a preselected plurality of winning card combinations, said plurality of winning card combinations comprising a lowest value card combination and a higher value card combination;

providing at least one player with the option of placing a wager;

displaying indicia of at least one playing card to at least one player;

displaying at least one additional card;

displaying indicia of a movable, payout indicator;

providing at least one player with an opportunity to change the amount of said player's wager;

providing said player with an opportunity to maximize said player's winnings even after receiving an indication of the hands ultimate outcome;

providing a winning payout based on said resulting wager if a plurality of said displayed cards matches at least one preselected winning card combination; and wherein said qualifying card combination has a higher value than the lowest card combination which provided a winning payout.

39. A method of playing a card game comprising the steps of:

providing a display surface;

providing a preselected plurality of winning card combinations, said plurality of winning card combinations comprising a highest value card combination and a lower value card combination;

providing at least one player with the option of placing a wager;

displaying indicia of at least one playing card to at least one player;

displaying at least one additional card;

displaying indicia of a movable, payout indicator;

providing at least one player with an opportunity to change the amount of said player's wager;

providing said player with an opportunity to maximize said player's winnings even after receiving an indication of the hands ultimate outcome;

providing a winning payout based on said resulting wager if a plurality of said displayed cards matches at least one preselected winning card combination; and wherein said qualifying card combination has a lower value than the highest card combination which provided a winning payout.

40. A method of playing a card game comprising the steps of:

providing a display surface;

displaying a winning payout schedule comprising a preselected plurality of winning card combinations;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable; and wherein said movable payout indicator comprises a wheel.

41. A method of playing a card game according to claim 40 wherein said player is provided with a plurality of opportunities to change the player's wager.

42. A method of playing a card game according to claim 40 wherein the total number of cards displayed is five.

43. A method of playing a card game according to claim 40 wherein the total number of cards displayed is greater than five.

44. A method of playing a card game according to claim 40 further comprising the step of rotating said wheel.

45. A method of playing a card game according to claim 44 wherein rotation of said wheel is initiated manually.

46. A method of playing a card game according to claim 45 wherein rotation of said wheel is controlled, at least in part, with means for randomly selecting the ultimate position of said wheel.

47. A method of playing a card game according to claim 46 wherein said selecting means comprises a stepper motor.

48. A method of playing a card game according to claim 44 wherein rotation of said wheel is initiated electronically.

49. A method of playing a card game according to claim 44 wherein winning payouts are provided according to a schedule which provides different payout odds for different amounts wagered, for at least one preselected winning combination.

50. A method of playing a card game according to claim 40 wherein said movable payout indicator is actuatable only if a player received a preselected qualifying card combination.

51. A method of playing a card game according to claim 40 further comprising the step of providing a winning player with an opportunity to double his winning payout.

52. A method of playing a card game according to claim 40 further comprising the step of providing a winning player with a plurality of opportunities to double said player's winning payout.

53. A method of playing a card game according to claim 40 where in the total number of cards displayed for each hand is seven.

54. A method of playing a card game comprising the steps of:

providing a display surface;

displaying a winning payout schedule comprising a preselected plurality of winning card combinations;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable;

wherein said movable payout indicator comprises a wheel;

wherein said movable payout indicator is actuatable only if a player has changed his initial wager.

55. A method of playing a card game comprising the steps of:

providing a display surface;

displaying a winning payout schedule comprising a preselected plurality of winning card combinations;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable;

wherein said movable payout indicator comprises a wheel;

wherein said movable payout indicator is actuatable only if a player has placed at least two wagers.

56. A method of playing a card game according to claim 55 wherein said movable payout indicator is actuatable only if a player has placed at least three wagers.

57. A method of playing a card game comprising the steps of:

providing a display surface;

displaying a winning payout schedule comprising a preselected plurality of winning card combinations, said plurality of winning card combinations comprising a lowest value card combination and a higher value card combination;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable;

wherein said movable payout indicator is actuatable only if a player received a preselected qualifying card combination; and wherein said qualifying card combination has a higher value than the lowest card combination which provides a winning payout.

58. A method of playing a card game comprising the steps of:

providing a display surface;

displaying a winning payout schedule comprising a preselected plurality of winning card combinations, said plurality of winning card combinations comprising a highest value card combination and a lower value card combination;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable;

wherein said movable payout indicator comprises a wheel;

wherein said qualifying card combination has a lower value than the highest card combination which provides a winning payout.

59. A method of playing a card game comprising the steps of:

providing a display surface;

displaying a winning payout schedule comprising a preselected plurality of winning card combinations;

providing at least one player with the option of placing a wager;

displaying a plurality of indicia of cards to at least one player;

providing at least one player with an opportunity to change said player's wager before receiving the number of cards in the highest winning payout on said winning payout schedule but after the player has a sufficient number of cards to obtain a winning payout thereby providing said player with an opportunity to maximize said player's winnings even after receiving an indication of the hands ultimate outcome;

displaying at least one additional card;

comparing a plurality of said displayed indicia of cards with said payout schedule; and if a plurality of said displayed cards matches at least one of said preselected winning card combinations, rendering a movable payout indicator actuatable;

providing a winning player with an opportunity to double his winning payout; and wherein a player's success in doubling a winning payout is displayed with said movable payout indicator.

* * * * *